US009163377B2

(12) United States Patent
France et al.

(10) Patent No.: US 9,163,377 B2
(45) Date of Patent: Oct. 20, 2015

(54) BUCKET DESIGN FOR MAXIMIZING LIQUID TRANSPORT

(71) Applicant: CATERPILLAR INC., Peoria, IL (US)

(72) Inventors: Sylvain France, Grenoble (FR); Jamel Necib, Rives sur Fure (FR)

(73) Assignee: Caterpillar Inc., Peoria, IL (US)

( * ) Notice: Subject to any disclaimer, the term of this patent is extended or adjusted under 35 U.S.C. 154(b) by 422 days.

(21) Appl. No.: 13/664,479

(22) Filed: Oct. 31, 2012

(65) Prior Publication Data

US 2014/0119869 A1 May 1, 2014

(51) Int. Cl.
*E02F 3/40* (2006.01)
*E02F 3/34* (2006.01)

(52) U.S. Cl.
CPC ..... *E02F 3/40* (2013.01); *E02F 3/3417* (2013.01); *Y10T 137/0318* (2013.01)

(58) Field of Classification Search
CPC ..... E02F 3/40
USPC ..... 414/722; 37/444
See application file for complete search history.

(56) References Cited

U.S. PATENT DOCUMENTS 4,459,768 A 7/1984 Albrecht
8,015,734 B1 * 9/2011 Mills et al. ..... 37/444

FOREIGN PATENT DOCUMENTS

GB 2350831 A 12/2000
JP 1988151727 A 1/1988
JP 2003176543 A 6/2003

* cited by examiner

*Primary Examiner* — Gerald McClain
(74) *Attorney, Agent, or Firm* — Miller, Matthias & Hull LLP

(57) ABSTRACT

A bucket for a machine, such as a wheel loader or track loader is disclosed. The bucket includes a bottom section connected to a top section by a middle section. The top, bottom and middle sections are connected to a pair of side walls. The bottom section includes a bottom distal edge and the top section includes a top distal edge. A rear side of the bucket includes a lower ear for receiving a lower pin. The lower pin connects the lower ear and the bucket to a lower linkage. A first distance between the lower pin and the bottom distal edge has a first length and a second distance between the lower pin and the top distal edge has a second length. A ratio of the first and second length, referred to as a loading index (LI) ranges from greater than 0.83 to less than 0.95.

20 Claims, 3 Drawing Sheets

BUCKET DESIGN FOR MAXIMIZING LIQUID TRANSPORT

BACKGROUND

1. Technical Field

This disclosure relates generally to buckets for machines, and more particularly, to bucket designs that maximize the liquid transport capability of the disclosed bucket designs.

2. Description of the Related Art

A machine, such as a wheel or track loader, may be equipped with a bucket assembly to perform operations at a work site. Such operations may include, for example, penetrating material in the ground or in a pile, scooping material, moving material, and depositing the material in a desired location. Sometimes, the material is a liquid or a slurry, such as water, mud or a cement slurry. The transport of liquids and slurries differs from the transport of granular solids and rocks because of the tendency of a liquid or slurry to spill from the bucket during transport. Using current bucket designs, it is more difficult and time consuming and therefore less efficient to transport liquids and slurries than granular solids.

Further, the level of performance achieved by a wheel loader operator using the wheel loader may depend, at least partially, on one or more design characteristics of the bucket. This is particularly true when the bucket is used to transport liquids and slurries as current buckets are designed primarily for transporting solid materials, not liquids and/or slurries.

SUMMARY OF THE DISCLOSURE

In one aspect, a bucket for a machine is disclosed. The disclosed bucket may include a bottom section connected to a top section by a middle section. The bottom, top and middle sections may be disposed between and connected to a pair of side walls. The bottom section may include a bottom distal edge while the top section may include a top distal edge. The middle section may also include a rear side that faces away from the top and bottom distal edges. The rear side may include a lower ear for receiving a lower pin. The lower pin may pivotally connect the lower ear and the bucket to a lower linkage. Wherein, a first distance between the lower pin and the bottom distal edge has a first length and a second distance between the lower pin and the top distal edge has a second length. Further, a ratio of the first length to the second length may range from greater than 0.83 to less than 0.95.

In another aspect, a machine is disclosed that includes a hydraulic system for powering a lower linkage and upper linkage. The machine may also include a bucket including a bottom section, a top section and a middle section disposed therebetween and connecting the bottom section to the top section. The bottom, top and middle sections may be disposed between and connected to a pair of sidewalls. The bottom section may include a bottom distal edge and the top section may include a top distal edge. The middle section may also include a rear side that faces away from the top and bottom distal edges. The rear side may include a lower ear with a lower bore for receiving a lower pin. The lower pin may pivotally connect the lower ear and the bucket to the lower linkage. The rear side may also include an upper ear with an upper bore for receiving an upper pin. The upper pin may pivotally connect the upper ear and the bucket to the upper linkage. Wherein, a first distance between the lower pin and the bottom distal edge has a first length and a second distance between the lower pin and the top distal edge has a second length. Further, a ratio of the first length to the second length may range from greater than 0.83 to less than 0.95.

In yet another aspect, a method is disclosed for transporting liquids and slurries. The disclosed method may include providing a loader having an upper linkage and a lower linkage. The upper and lower linkages may be pivotally connected to a bucket by upper and lower pins respectively to pass through upper and lower ears respectively. The upper and lower ears may be disposed on a rear side of the bucket. The bucket may also include a bottom section, a top section and a middle section disposed therebetween and connecting the bottom section to the top section. The bottom, top and middle sections may be disposed between and connected to a pair of sidewalls. The bottom section may include a bottom distal edge and the top section may include a top distal edge. Wherein, a first distance between the lower pin and the bottom distal edge has a first length and a second distance between the lower pin and the top distal edge has a second length. Further, a ratio of the first length to the second length may range from greater than 0.83 to less than 0.95. The method may further include lowering the bucket into a supply of liquid or slurry and at least substantially filling the bucket with said liquid or slurry. The method may then include moving the bucket to a full rack position followed by transporting the machine, liquid or slurry and bucket, while the bucket is in the full rack position.

DETAILED DESCRIPTION OF THE PRESENTLY PREFERRED EMBODIMENTS

Figure 1:
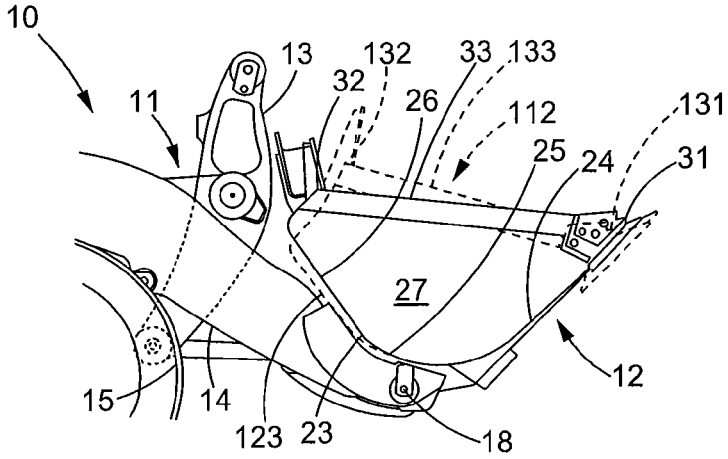
FIG. 1 is a side view of an exemplary machine, with a disclosed bucket in a fully racked position and further illustrating a prior art bucket shown in phantom lines, also in the fully racked position.

FIG. 1 illustrates an exemplary machine 10. The machine 10 may embody a mobile machine, such as a wheel loader, a track loader or any other machine that performs operations associated with an industry including, for example, mining, construction, farming or transportation. The machine 10 may include a linkage assembly 11 that is coupled to a bucket 12. The linkage assembly 11 may include an upper linkage 13, a lower linkage 14 and an actuator assembly (not shown) for moving the bucket 12 to perform operations such as engaging, scooping, lifting, transporting, lowering and dumping of material. The machine 10 may also include a plurality of ground engaging devices 15 in the form of one or more tracks or a plurality of wheels. In addition to the bucket 12 shown in solid lines, FIG. 1 also illustrates use of a prior art bucket 112 shown in phantom lines. Both the disclosed bucket 12 and the prior art bucket 112 are shown in a "fully racked" position wherein the buckets 12, 112 have been rotated fully in the counterclockwise direction from the perspective of FIG. 1. The fully racked position shown in FIG. 1 is the position where the machine 10 may move from one position to another with the buckets 12, 112 full of material. For purposes of this disclosure, it will be assumed that the buckets 12, 112 are full of a liquid or a slurry.

Figure 3:
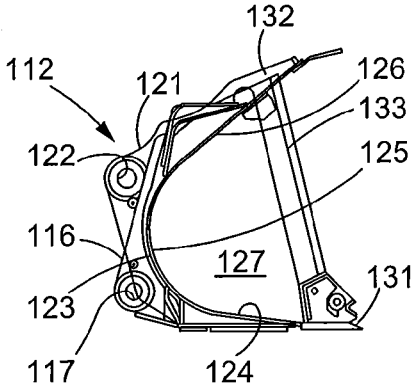
FIG. 3 (Prior Art)
FIG. 3 is a side view of a prior art bucket shown in a ground level position.
Figure 4:
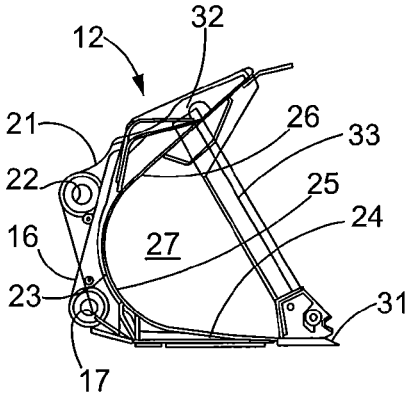
FIG. 4 is a side view of a disclosed bucket, also shown in a ground level position.

Turning briefly to FIGS. 3-4, separate images of the buckets 112, 12 are shown. Each bucket includes a lower ear 16, 116 with a bore 17, 117 disposed therein. The bore 17, 117 receives a lower pin 18 as shown in FIG. 1 which pivotally couples the lower linkage 14 to the lower ear 16, 116 and the buckets 12, 112. Further, each bucket 12, 112 also includes an upper ear 21, 121, also equipped with a bore 22, 122 for receiving an upper pin (not shown) which couples the upper linkage 13 to the buckets 12, 112. The ears 16, 21, 116, 121 are connected to their respective buckets 12, 112 at a rear side 23, 123.

Returning to FIGS. 1 and 3-4 together, the buckets 12, 112 each include a bottom section 24, 124, a middle section 25, 125 and a top section 26, 126. The middle sections 25, 125 connect the bottom sections 24, 124 to the top sections 26, 126. The bottom, middle and top sections 24, 25, 26 and 124, 125, 126 are disposed between and connected to a pair of side walls, only one of which is shown at 27, 127 in FIGS. 1 and 3-4. The bottom sections 24, 124 terminate at a bottom distal edge, 31, 131 respectively. The top sections may also terminate at a top distal edge 32, 132 respectively. Similarly, the top and bottom distal edges 31, 32 and 131, 132 may define a strike plane 33, 133 respectively. The importance of these elements will be described below in connection with FIG. 2.

Figure 2:
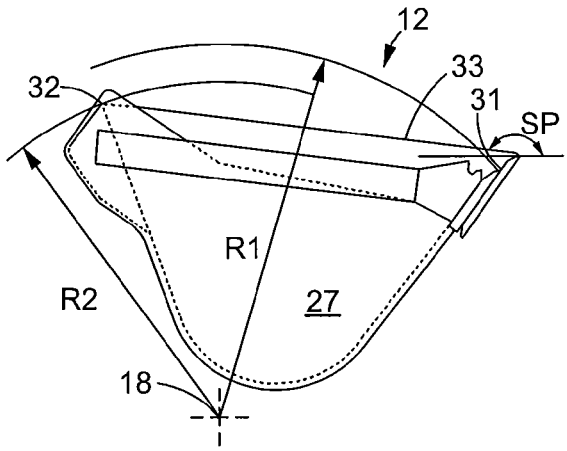
FIG. 2 is a side view of the bucket disclosed in FIG. 1, particularly illustrating the performance enhancing design aspects.

Turning to FIG. 2, the lower pin 18 may be disposed a first distance R1 from the bottom distal edge 31. Similarly, the lower pin 18 may be disposed a second distance R2 from the top distal edge 32 as shown in FIG. 2. It has been surprisingly found that the ratio R1/R2 can serve as an important perimeter when designing a bucket 12 to provide more liquid transport capability. Specifically, the ratio R1/R2, also referred to as the loading index (LI) for a prior art bucket 112 may be in the range of 0.81 or less to about 0.83 or less. In contrast, the ratio or LI for the disclosed bucket 12 may range from greater than 0.83 to less than 0.95. It is has also been surprisingly found that as the LI approaches unity, the liquid capacity of the bucket 12 increases. Thus, by changing the dimensions of the bucket 12 and, more specifically, increasing R1 while maintaining or decreasing R2 to provide an LI of greater than 0.83, for example, about 0.89, the increase in the liquid transport capability of the bucket 12 can be increased without requiring a redesign of the upper and lower linkages 13, 14 of the machine 10. Thus, when the machine 10 is to be used for transporting liquids or slurries, the machine 10 can be quickly retrofitted with an improved bucket 12 for transporting such liquids and slurries.

In FIG. 2, it will also be noted that the bottom distal edge 31 and top distal edge 32 may define a strike plane 33. In FIG. 1, with the buckets 12, 112 in the fully racked position, it will be noted that the strike plane 33 may either be at a horizontal position or closer to a horizontal position than the strike plane 133. As a result, when the bucket 112 is full, and the fully racked position shown in FIG. 1, some liquid may spill out of the bucket 112. In contrast, with the bucket 12 full, in the fully racked position shown at FIG. 1, the liquid or slurry will remain within the bucket 12 due to the more horizontal posture of the strike plane 33.

Figure 5:
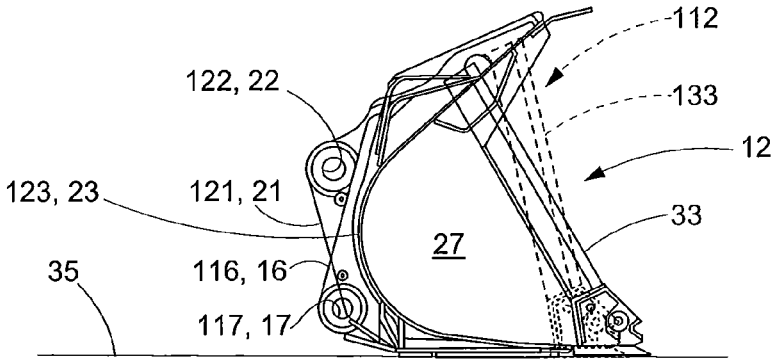
FIG. 5 is a side view of the disclosed bucket super imposed over the prior art bucket, shown in phantom.

Turning to FIG. 5, to achieve the more horizontal strike plane 33 shown in FIGS. 1 and 2 for the fully racked position, the strike plane is less vertical when in the ground level position shown in FIG. 5. Specifically, in FIG. 5, the strike plane 33 may be disposed at an angle of about 60° with respect to the ground 35. In contrast, the strike plane 133 of the bucket 112 may be disposed at an angle of about 75° with respect to the ground 35. The more inclined strike plane 35 when the bucket 12 is in the ground level position shown in FIG. 5 makes it easier to achieve a horizontal strike plane when the bucket 12 is in the fully racked position shown in FIG. 1.

Figure 6:
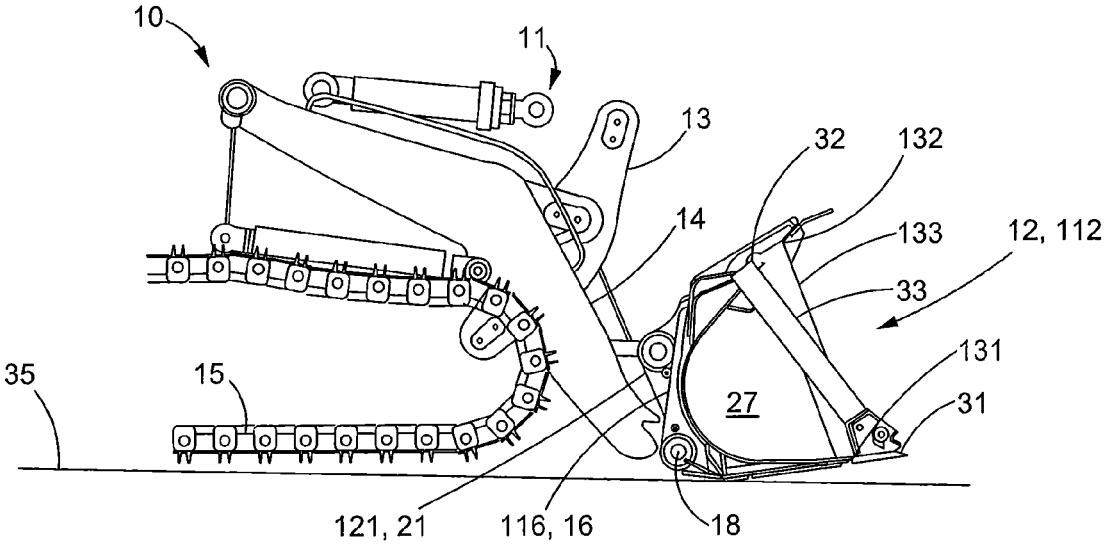
FIGS. 6, 7 and 8 are side views of a disclosed machine equipped with a disclosed bucket that has been super-imposed over a prior art bucket, shown in phantom, and particularly illustrating the disclosed and prior art buckets in a ground level position or near ground level position (FIGS. 5-6) and the position where about ⅓ of the maximum lift height has been achieved (FIG. 7) and, finally, a position where about ⅓ of the maximum lift height has been achieved and the buckets are fully retracted to a full rack position (FIG. 8).
Figure 7:
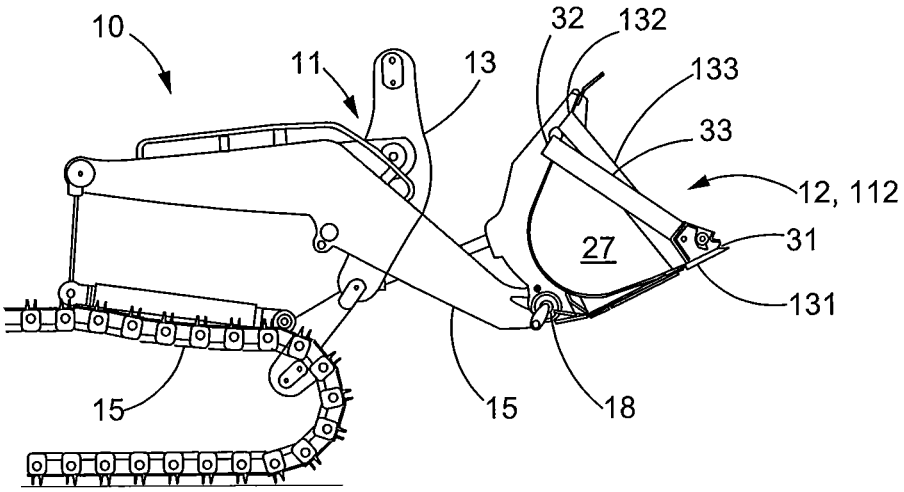
Figure 8:
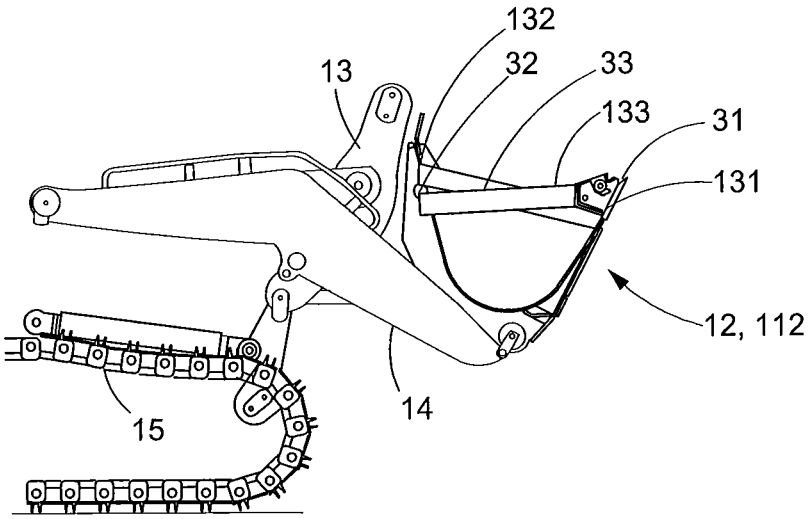

Further, in addition to having a larger capacity in the fully racked position shown in FIGS. 1 and 8, the disclosed bucket 12 may experience less spillage as it is lifted off of the ground from the position shown in FIG. 6 to a ⅓ lift height position shown in FIG. 7 and further to a ⅓ lift height full rack position shown in FIG. 8. In short, the strike plane 33 of the disclosed bucket 12 may be closer to horizontal and all three positions, thereby providing less spillage and increased liquid transport capacity.

INDUSTRIAL APPLICABILITY

A bucket 12 is disclosed that provides increased capacity for transporting liquids and slurries without requiring an retrofit of the linkage system 11 of the machine 10. An improved method for transporting liquids and slurries using such a bucket 12 is also disclosed. The disclosed method includes providing a machine or loader 10 having an upper linkage 13 and a lower linkage 14. The upper and lower linkages 13, 14 may be pivotally coupled to the bucket by an upper pin (not shown) and a lower pin 18 that pass through lower and upper ears 16, 21 respectively. The lower and upper ears 16, 21 may be disposed on a rear side 23 of the bucket 12. The bucket 12 may also include a bottom section 24, a top section 26 and a middle section 25 disposed therebetween and connecting the bottom section 24 to the top section 26. The bottom, top and middle sections 24, 26, 25 may be disposed between and connected to a pair of side walls, only one of which is shown at 27. The bottom section 24 may include a bottom distal edge 31 and the top section 26 may include a top distal edge 32. A first distance between the lower pin 18 and the bottom distal edge 31 may have a first length R1 and a second distance between the lower pin 18 and the top distal edge 32 may have a second length R2. A ratio of the first length R1 to the second length R2 may be defined as a loading index (LI) and may range from greater than 0.83 to less than 0.95. The disclosed method may also include lowering the bucket into a supply of liquid or slurry and at least substantially filling the bucket with said liquid or slurry. The method may further include moving the bucket to a full rack position so that a strike plane 33 defined by the bottom distal edge 31 and the top distal edge 32 is in a near horizontal or horizontal position, followed by transporting the machine 10 with the bucket 12 loaded with liquid or slurry.

What is claimed:

1. A bucket for a machine, the bucket comprising:

a bottom section connected to a top section by a middle section, the bottom, top and middle sections disposed between and connected to a pair of sidewalls, the bottom section including a bottom distal edge, the top section including a top distal edge;

the middle section also including a rear side that faces away from the top and bottom distal edges, the rear side including a lower ear for receiving a lower pin, the lower pin pivotally connecting the lower ear and the bucket to a lower linkage;

wherein a first distance between the lower pin and the bottom distal edge has a first length and a second distance between the lower pin and the top distal edge has a second length, a ratio of the first length to the second length ranging from greater than 0.83 to less than 0.95.

2. The bucket of claim 1 wherein the ratio ranges from greater than 0.83 to less than about 0.90.

3. The bucket of claim 1 wherein the ratio ranges from about 0.88 to about 0.90.

4. The bucket of claim 1 wherein the top and bottom distal edges define a strike plane, and wherein the strike plane is in an at least substantially horizontal position when the bucket is held in a transport position.

5. The bucket of claim 1 wherein the top and bottom distal edges define a strike plane, and wherein the strike plane is substantially parallel to a plane defined by a ground surface on which the machine is moving when the bucket is held in a transport position.

6. The bucket of claim 1 wherein the top and bottom distal edges define a strike plane, and wherein the strike plane is disposed at an angle of less than 75° with respect to a plane defined by a ground surface on which the machine is disposed when the bucket is held in a downward resting position.

7. The bucket of claim 1 wherein the top and bottom distal edges define a strike plane, and wherein the strike plane is disposed at an angle of about 60° with respect to a plane defined by a ground surface on which the machine is disposed when the bucket is held in a downward resting position.

8. A machine comprising:

a hydraulic system for powering a lower linkage and an upper linkage;

a bucket including a bottom section, a top section and a middle section disposed therebetween and connecting the bottom section to the top section, the bottom, top and middle sections being disposed between and connected to a pair of sidewalls, the bottom section including a bottom distal edge and the top section including a top distal edge;

the middle section also including a rear side that faces away from the top and bottom distal edges, the rear side including a lower ear with a lower bore for receiving a lower pin, the lower pin pivotally connecting the lower ear and the bucket to the lower linkage, the rear side also including an upper ear with an upper bore for receiving an upper pin, the upper pin pivotally connecting the upper ear and the bucket to the upper linkage;

wherein a first distance between the lower pin and the bottom distal edge has a first length and a second distance between the lower pin and the top distal edge has a second length, a ratio of the first length to the second length ranging from greater than 0.83 to less than 0.95.

9. The machine of claim 8 wherein the ratio ranges from greater than 0.83 to less than about 0.90.

10. The machine of claim 8 wherein the ratio ranges from about 0.88 to about 0.90.

11. The machine of claim 8 wherein the top and bottom distal edges define a strike plane, and wherein the strike plane is in an at least substantially horizontal position when the upper and lower linkages and the bucket are held in a transport position.

12. The machine of claim 8 wherein the top and bottom distal edges define a strike plane, and wherein the strike plane is substantially parallel to a plane defined by a ground surface on which the machine is moving when the upper and lower linkages and the bucket are held in a transport position.

13. The machine of claim 8 wherein the top and bottom distal edges define a strike plane, and wherein the strike plane is disposed at an angle of less than 75° with respect to a plane defined by a ground surface on which the machine is disposed when the bucket is held in a downward resting position.

14. The machine of claim 8 wherein the top and bottom distal edges define a strike plane, and wherein the strike plane is disposed at an angle of about 60° with respect to a plane defined by a ground surface on which the machine is disposed when the bucket is held in a downward resting position.

15. The machine of claim 8 wherein the machine is a wheel loader or a track loader.

16. A method for transporting liquids and slurries, the method comprising:

providing a loader having an upper linkage and a lower linkage, the upper and lower linkages being pivotally coupled to a bucket by upper and lower pins respectively that pass through upper and lower ears respectively, the upper and lower ears being disposed on a rear side of the bucket, the bucket also including a bottom section, a top section and a middle section disposed therebetween and connecting the bottom section to the top section, the bottom, top and middle sections being disposed between and connected to a pair of sidewalls, the bottom section including a bottom distal edge and the top section including a top distal edge, wherein a first distance between the lower pin and the bottom distal edge has a first length and a second distance between the lower pin and the top distal edge has a second length, a ratio of the first length to the second length ranging from greater than 0.83 to less than 0.95;

lowering the bucket into a supply of liquid or slurry and at least substantially filling the bucket with said liquid or slurry;

moving the bucket to a full rack position; and transporting the machine.

17. The method of claim 16 wherein the ratio ranges from greater than 0.83 to less than about 0.90.

18. The method of claim 16 wherein the ratio ranges from about 0.88 to about 0.90.

19. The method of claim 16 wherein the top and bottom distal edges define a strike plane, and wherein the strike plane is in an at least substantially horizontal position when the upper and lower linkages and the bucket are held in the fully racked position.

20. The method of claim 19 wherein the strike plane is disposed at an angle of less than 75° with respect to a plane defined by a ground surface on which the machine is disposed when the bucket is held in a downward resting position.

* * * * *